US006402492B1

(12) United States Patent
Achterwinter et al.

(10) Patent No.: US 6,402,492 B1
(45) Date of Patent: Jun. 11, 2002

(54) APPARATUS FOR PRODUCING SPUN BOND

(75) Inventors: Norbert Achterwinter, Hilden; Peter Eilers, Troisdorf; Nicole Langen, Bonn, all of (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 15 days.

(21) Appl. No.: 09/643,341

(22) Filed: Aug. 22, 2000

(30) Foreign Application Priority Data

Aug. 25, 1999 (DE) ..... 199 40 333

(51) Int. Cl.[7] ..... B29C 47/90
(52) U.S. Cl. ..... 425/72.2; 425/83.1; 425/378.2
(58) Field of Search ..... 425/66, 72.2, 83.1, 425/377, 378.2

(56) References Cited

U.S. PATENT DOCUMENTS 4,157,724 A * 6/1979 Persson ..... 425/83.1
4,352,649 A * 10/1982 Jacobsen et al. ..... 425/83.1
4,353,686 A * 10/1982 Hosler et al. ..... 425/83.1
5,460,500 A 10/1995 Geus et al. ..... 425/66
5,487,655 A * 1/1996 Frey et al. ..... 425/72.2

FOREIGN PATENT DOCUMENTS

DE 37 36 418 C2 11/1988
DE 43 12 419 C2 10/1994

* cited by examiner

*Primary Examiner*—Robert Davis
*Assistant Examiner*—Joseph Leyson
(74) *Attorney, Agent, or Firm*—Herbert Dubno

(57) ABSTRACT

An apparatus for producing a spun-bond web with a spinneret located above the upper pass of an endless collecting sieve belt below which a suction is generated through an elongated slot extending the full width of that upper pass. Swingable flaps are provided along longitudinal edges of the intake slot and can be swung, e.g. independently, to vary the width and position at which the suction is applied to the underside of the upper pass of the belt.

7 Claims, 2 Drawing Sheets

APPARATUS FOR PRODUCING SPUN BOND

FIELD OF THE INVENTION

Our present invention relates to an apparatus for producing a spun-bond web from synthetic resin filaments.

BACKGROUND OF THE INVENTION

In general, the production of a spun-bond web involves the emission from a spinneret or spinning head of a curtain of synthetic resin filaments which are collected on an endless deposition belt through which air is drawn by a suction device located below the upper pass of the continuously moving belt. In the deposition region, the filaments deposit in intertwined loops and bond together to form the web. Below the upper pass of the fluid-permeable or sieve belt, a suction device has generally a rectangular inlet which extends the full width of the belt and confines the suction zone to a region substantially immediately below the descending curtain of the synthetic resin filaments.

An apparatus of this type is described, for example, in German patent document DE 43 12 419 C2 and in the corresponding U.S. Pat. No. 5,460,500. The flow and pressure conditions in the web-forming and filament-deposition region are generally controlled only by varying the setting of the suction blower which forms the mechanism for drawing the air through the belt.

OBJECTS OF THE INVENTION

It is the principal object of the present invention to provide a relatively simple system which facilitates control of the parameters with which air is drawn through the web forming on the collection belt and through that belt to thereby increase the versatility of the apparatus.

It is a more specific object of the invention to provide an apparatus which can more easily influence the spun-bond web formation, afford greater variability of the product made, and in general, improve a spun-bond product produced by an apparatus of the type described.

It is also an object of the invention to provide an improved apparatus for producing a spun-bond web with better adjustability of the suction, flow and pressure conditions in the web formation region and for introducing greater variability in these parameters.

A further object of our invention is to provide a spun-bond producing apparatus which represents an advance over earlier apparatus for the production of spun bond.

SUMMARY OF THE INVENTION

These objects and others which will become apparent hereinafter are attained, in accordance with the invention, by providing along both longitudinal edges of the suction intake of a spun-bond producing apparatus of the type described, respective baffle flaps which are pivotally mounted along these edges, extend the full width of the upper pass of the belt and are tiltable individually (independently) or together. More particularly, an apparatus for producing a spun-bond web according to this invention can comprise:

means including a spinneret for producing a descending curtain of thermoplastic synthetic resin filaments;

an endless fluid-permeable belt having an upper pass located below the spinneret for collecting the filaments and forming a spun-bond web therefrom;

a suction device below the upper pass of the belt having an elongated inlet extending transversely to the upper pass of the belt and below the upper pass for drawing air through the upper pass of the belt and the filaments downwardly onto the upper pass of the belt, the inlet having a pair of opposite longitudinal edges; and a respective baffle flap pivotally mounted at each of longitudinal edges an extending from the respective longitudinal edge substantially to the upper pass of the belt over an entire length of the inlet and swingable to vary the draw of air through the belt.

The invention is based upon our discovery that a significant increase in the variability of the flow and pressure conditions in the deposition region or web-forming regions can be achieved by varying the shape and width of the suction passage intake below the upper pass of the belt. This is achieved in a simple manner, according to the invention by swingable baffles which can be swung toward and away from one another or swung independently to various positions. In this manner both the size and position of the intake with respect to the underside of the upper pass of the belt can be varied within wide ranges.

In a preferred embodiment of the invention, the two flaps are adjustable independently from one another and for that purpose each of the flaps may be provided with a respective actuator.

The flaps can be of solid-wall or perforated construction and it has been found to be advantageous, in some cases, to provide a combination of a solid-wall or nonperforated flap on one longitudinal edge and a perforated flap on the other longitudinal edge.

The use of perforated flaps not only allows the upper edges of the flap to control the width and position of the intake, but also induces flow through the perforations which affect the character (turbulence, etc.) of the airstream adjacent the upper pass of the belt.

To avoid undesired air flow, it has been found to be advantageous to provide upper edges of the flaps with respective round sections which can, if desired, actually engage the underside of the belt.

In all cases it has been found to be desirable, in addition, to provide the blower as an adjustable capacity blower.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
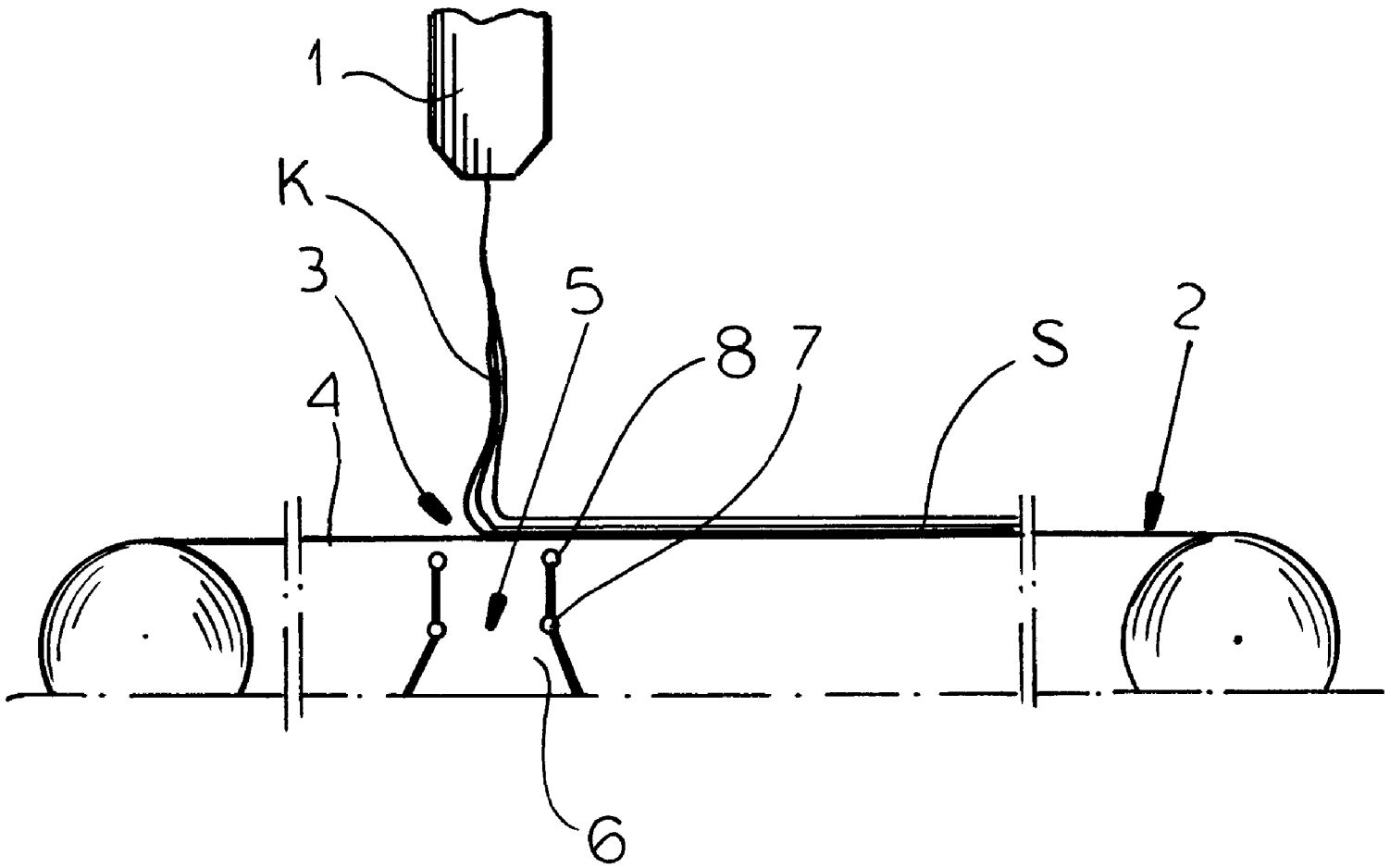
FIG. 1 is a partial cross section through an apparatus for producing a spun-bond web according to the invention.

The apparatus shown in the drawing can be used to produce a spun-bond web S from a curtain of synthetic resin filaments K produced by a spinning head or spinneret 1. The filaments K emerge from the spinning orifices of the head 1 and, below the head 1, are collected on the upper pass of an endless continuously-circulating collection belt 2 which is air-permeable and can be perforated, i.e. a sieve belt, the jumbled and intertwined filaments bonding into the web S which is a nonwoven web which can be referred to as a mat or fleece.

In the collection region 3 for the synthetic resin filaments K, the upper pass 4 of the belt 2 passes over an intake 5 of a suction unit 6 having a blower (not shown) and a motor 11 driving that blower and drawing air downwardly through the upper pass 4 of the belt. The motor 11 is of variable speed for control of the throughput of the blower and hence the volume rate of flow of air through the belt and the web S and the control of the pressure differential thereacross.

Figure 2:
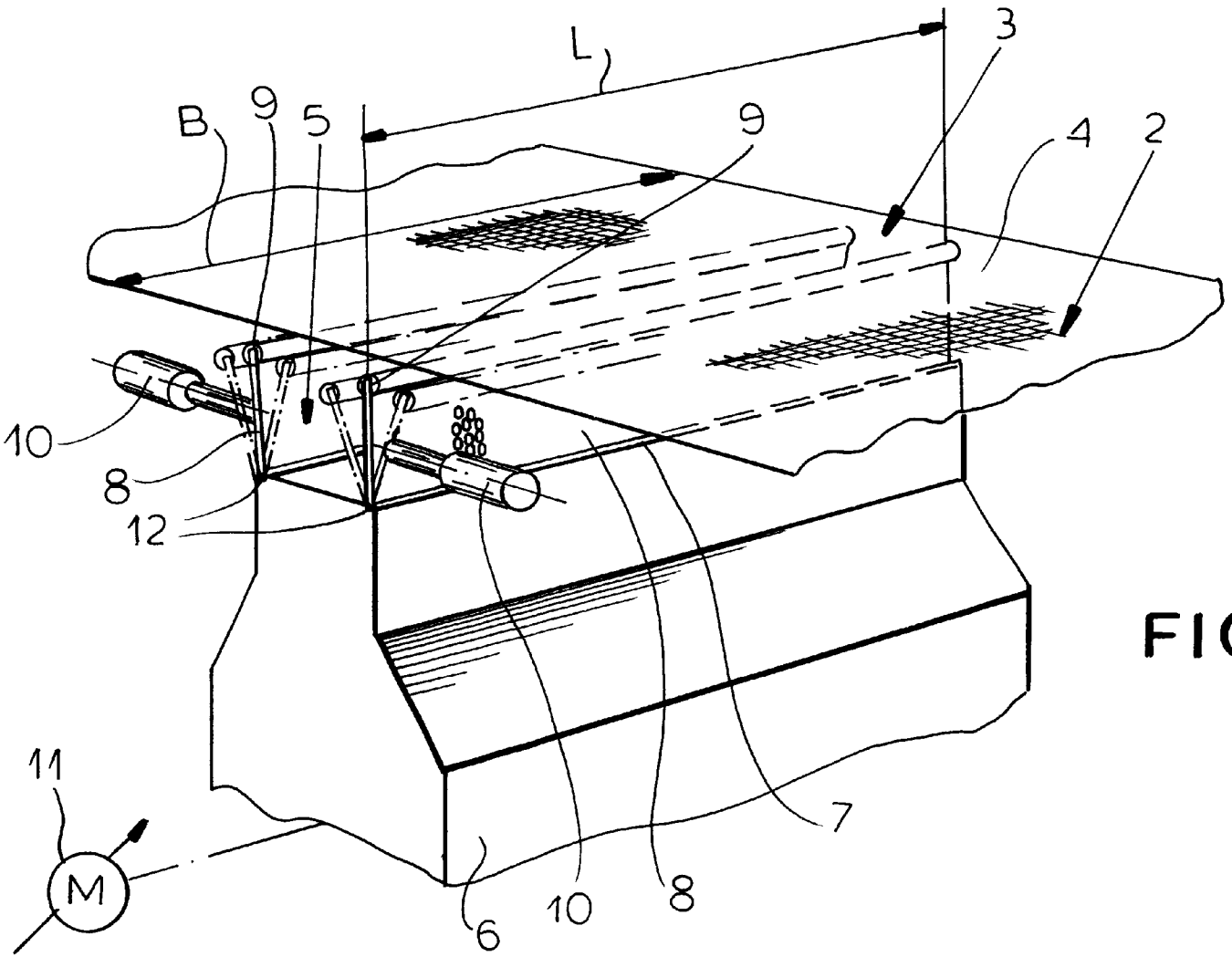
FIG. 2 is a perspective view of a portion of the suction apparatus or unit for this spun-bond-web making unit.

As can be seen from FIG. 2, along each of the two longitudinal edges 7 of the intake 5 a respective baffle flap 8 is hinged or pivotally connected, the pivots being represented at 12. The flaps 8 extend the full width B of the belt pass 4 and the full length L of the intake 5. The flaps 8 extend toward the underside of the upper pass 4 and are each swingable on the respective upper edge 7.

The flaps are provided with independently energizable actuators 10, e.g. fluid cylinders (hydraulic or pneumatic) and at least one but preferably both of the flaps 8 can be formed from perforated sheet metal or plastic. In addition, the free upper edges of the flaps 8 are provided with round sections 9.

As will be apparent from FIG. 2, using the actuators 10 the flaps individually can be shifted to vary the width of the intake and the position of the intake below the spinneret 1, and, if desired, the flaps may be swung back and forth periodically or aperiodically during deposition of the web S to vary the character thereof.

We claim:

1. An apparatus for producing a spun-bond web comprising:

means including a spinneret for producing a descending curtain of thermoplastic synthetic resin filaments;

an endless fluid-permeable belt having an upper pass located below said spinneret for collecting said filaments and forming a spun-bond web therefrom;

a suction device below said upper pass of said belt having an elongated inlet extending transversely to said upper pass of said belt and below said upper pass for drawing air through said upper pass of said belt and said filaments downwardly onto said upper pass of said belt, said inlet having a pair of opposite longitudinal edges; and a respective baffle flap pivotally mounted at each of the longitudinal edges and extending from the respective longitudinal edge substantially to the upper pass of the belt over an entire length of said inlet and swingable to vary the draw of air through said belt.

2. The apparatus defined in claim 1 wherein said baffle flaps are adjustable pivotally independently from one another.

3. The apparatus defined in claim 1, further comprising respective actuators connected to said flaps for swingably displacing same.

4. The apparatus defined in claim 1 wherein at least one of said flaps is composed of an unperforated plate.

5. The apparatus defined in claim 1 wherein at least one of said flaps is composed of a perforated plate.

6. The apparatus defined in claim 1, further comprising a rounded cross section member on an upper edge of at least one of said flaps.

7. The apparatus defined in claim 1, further comprising means for varying suction generated by said device below said upper pass of said belt.

* * * * *